US009206378B2

(12) United States Patent
Okuda et al.

(10) Patent No.: US 9,206,378 B2
(45) Date of Patent: Dec. 8, 2015

(54) PLUNGER WATER-SOLUBLE LUBRICANT FOR DIE-CASTING

(75) Inventors: Tokiyoshi Okuda, Anjo (JP); Hiroshi Douzono, Okazaki (JP); Takeshi Yamauchi, Okazaki (JP); Fujiaki Nagasaki, Anjo (JP); Shinsuke Ukai, Anjo (JP); Motonori Takeue, Nara-ken (JP)

(73) Assignees: AISIN SEIKI KABUSHIKI KAISHA, Kariya-shi (JP); NIPPON QUAKER CHEMICAL, LTD., Yao-shi (JP)

( * ) Notice: Subject to any disclaimer, the term of this patent is extended or adjusted under 35 U.S.C. 154(b) by 151 days.

(21) Appl. No.: 14/113,351

(22) PCT Filed: Apr. 16, 2012

(86) PCT No.: PCT/JP2012/060261

§ 371 (c)(1),
(2), (4) Date: Dec. 13, 2013

(87) PCT Pub. No.: WO2012/144457

PCT Pub. Date: Oct. 26, 2012

(65) Prior Publication Data

US 2014/0087981 A1 Mar. 27, 2014

(30) Foreign Application Priority Data

Apr. 22, 2011 (JP) ..... 2011-096083

(51) Int. Cl.

| | |
|---|---|
| ***C10M 173/00*** | (2006.01) |
| ***C10M 101/00*** | (2006.01) |
| ***C10M 103/00*** | (2006.01) |
| ***C10M 125/26*** | (2006.01) |
| ***C10M 129/26*** | (2006.01) |
| ***C10M 169/04*** | (2006.01) |

(52) U.S. Cl.

CPC ..... *C10M 169/04* (2013.01); *C10M 173/00* (2013.01); *C10M 2201/105* (2013.01); *C10M 2203/1006* (2013.01); *C10M 2207/125* (2013.01); *C10M 2207/126* (2013.01); *C10M 2207/128* (2013.01); *C10M 2207/283* (2013.01); *C10M 2207/2805* (2013.01); *C10M 2207/401* (2013.01); *C10M 2219/044* (2013.01); *C10N 2210/02* (2013.01); *C10N 2230/06* (2013.01); *C10N 2240/58* (2013.01)

(58) Field of Classification Search

CPC ..... C10M 2207/283; C10M 2207/125; C10M 2207/128; C10M 2207/126; C10M 2219/044; C10M 2203/1006; C10M 2201/105; C10M 2207/2805; C10M 2207/401; C10M 169/04; C10M 173/00; C10N 2230/06; C10N 2240/58; C10N 2210/02; C10N 2220/082

USPC ..... 508/136, 161, 523, 315, 318, 336

See application file for complete search history.

(56) References Cited

U.S. PATENT DOCUMENTS

| | | | | |
|---|---|---|---|---|
| 6,194,357 | B1 * | 2/2001 | Murata et al. | 508/113 |
| 2003/0155094 | A1 * | 8/2003 | Edwards | 164/72 |

FOREIGN PATENT DOCUMENTS

| | | | |
|---|---|---|---|
| CN | 101974361 | A * | 2/2011 |
| JP | 4 198395 | | 7/1992 |
| JP | 5 156278 | | 6/1993 |
| JP | 6 065590 | | 3/1994 |
| JP | 7 062376 | | 3/1995 |
| JP | 9 276981 | | 10/1997 |
| JP | 2000 015419 | | 1/2000 |
| JP | 2000 301286 | | 10/2000 |

OTHER PUBLICATIONS

Combined Chinese Office Action and Search Report issued Jun. 10, 2014 in Patent Application No. 201280019713.1 (with English language translation).

International Search Report Issued Jul. 24, 2012 in PCT/JP12/60261 Filed Apr. 16, 2012.

* cited by examiner

*Primary Examiner* — Pamela H Weiss

(74) *Attorney, Agent, or Firm* — Oblon, McClelland, Maier & Neustadt, L.L.P.

(57) ABSTRACT

A plunger water-soluble lubricant for die-casting includes a component (a) being one or more than one of compounds selected from the group consisting of a mineral oil, a synthetic hydrocarbon, a grease, and a fatty acid ester; a component (b) being one or more than one of compounds selected from the group consisting of an alkali metal salt of a higher fatty acid and an alkali metal salt of an aliphatic hydroxy acid; a component (c) being one or more than one of compounds selected from the group consisting of an alkali metal salt of a synthetic sulfonic acid and an alkali metal salt of a petroleum sulfonic acid; particulate silica; and water. This water-soluble lubricant for die-casting has a low burnability (flammability), and exerts an excellent lubricating property without lowering the productivity and worsening the working environment.

14 Claims, No Drawings

PLUNGER WATER-SOLUBLE LUBRICANT FOR DIE-CASTING

This application is a 371 of PCT/JP12/60261, filed Apr. 16, 2012. Priority to Japanese patent application 2011-096083, filed Apr. 22, 2011, is claimed.

TECHNICAL FIELD

The present invention relates to a plunger lubricant for die-casting, the lubricant being supplied between a plunger for injecting molten metal (e.g., aluminum) into a die-cast mold and a sleeve in which the plunger reciprocates.

BACKGROUND ART

In die-casting of metal material (e.g., aluminum), it is necessary to reduce an abrasion/friction of the sleeve on sliding surfaces between the plunger for injecting molten metal into the die-cast mold and the sleeve in which the plunger reciprocates, and to stabilize an injection speed by the plunger. Therefore, a plunger lubricant is supplied between the plunger and the sleeve (especially, onto inner walls of the sleeve). As the lubricant, an oil-based lubricant is widely used, the oil-based lubricant being an oil in which solid substances, such as graphite powders and talcum powders, are dispersed. Such an oil-based lubricant in which the solid substances are dispersed has an excellent lubricating property.

However, when the oil-based lubricant in which the solid substances are dispersed is used, residues (especially, black residues) adhere to a surround/circumference of the die-cast apparatus. The residues are hard to be cleaned up because they contain the oil, the graphite, or the like, in large amount, and thus, there arises a problem of worsening a working environment. In addition, when the molten metal is poured into the sleeve after the oil-based lubricant is provided into the sleeve, the oil-based lubricant is exposed to a high temperature environment, and thus, the oil components may burn. This may damage the plunger, the sleeve, and the like, of the die-cast apparatus. Further, gases generate due to burning of the oil components, and when the gases mix into the molten metal, internal defects (e.g., casting porosity) occur in the cast product, resulting in a deterioration in quality of the cast product.

In order to solve the above described problems caused by the oil-based lubricant, a lubricant having low flammability is required. As such a lubricant, a water-soluble lubricant in which water is added to the oil-based lubricant is proposed. Patent literature 1 discloses a lubricant which is a W/O type emulsion containing a mineral oil, a grease, or the like, used as a base oil, and a surface-active agent. Patent literature 2 discloses a water-soluble lubricant in which a metal salt of higher fatty acid serving as a base compound is dispersed with a surface-active agent.

CITATION LIST

Patent Literature

[Patent Literature 1]
Japanese Patent Application Laid-Open (kokai) No. 2000-15419
[Patent Literature 2]
Japanese Patent Application Laid-Open (kokai) No. Hei 6-65590

SUMMARY OF THE INVENTION

Technical Problems to be Solved by the Present Invention

However, the lubricant (the lubricant which is the W/O type emulsion containing a mineral oil, a grease, or the like, and a surface-active agent) disclosed in the patent literature 1 is not satisfactorily hard to burn because it contains a great amount of oil components. The lubricant (the water-soluble lubricant in which a metal salt of higher fatty acid is dispersed with a surface-active agent) disclosed in the patent literature 2 is hard to burn to some degree, but does not have satisfactorily excellent lubricating property, compared with the oil-based lubricant.

As described above, a water-soluble lubricant used as the plunger lubricant for die-casting has not been found, which exerts a lubricating property which is equally excellent as one which the oil-based lubricant exerts in which the graphite powders are dispersed, and which is satisfactorily hard to burn when contacting with the molten metal.

An object of the present invention is to provide a plunger water-soluble lubricant for die-casting, which is hard to burn, exerts an excellent lubricating property, and neither lower the productivity nor worsen the working environment.

Solution to Problem

The present invention provides a plunger water-soluble lubricant for die-casting including: a component (a) being one or more than one of compounds selected from the group consisting of a mineral oil, a synthetic hydrocarbon, a grease, and a fatty acid ester; a component (b) being one or more than one of compounds selected from the group consisting of an alkali metal salt of a higher fatty acid and an alkali metal salt of an aliphatic hydroxy acid; a component (c) being one or more than one of compounds selected from the group consisting of an alkali metal salt of a synthetic sulfonic acid and an alkali metal salt of a petroleum sulfonic acid; particulate silica; and water.

The plunger water-soluble lubricant for die-casting of the present invention exerts an excellent lubricating property. Therefore, the lubricant can reduce an abrasion of the sleeve during casting, and does not lower the injection speed of the plunger. Accordingly, using the lubricant of the present invention for plunger lubrication allows a high quality product to be manufactured by die casting without lowering the productivity. In addition, the plunger water-soluble lubricant for die-casting of the present invention has low flammability (burnability), and thus, it is possible to satisfactorily suppress the burn of the lubricant when the lubricant contacts with the molten metal.

DESCRIPTION OF EMBODIMENTS

The plunger water-soluble lubricant for die-casting (hereinafter, also simply referred to as the "lubricant") according to the present invention includes at least components (a) to (c), particulate silica, and water.

<Component (a)>

The component (a) is one or more than one of compounds selected from the group consisting of a mineral oil, a synthetic hydrocarbon, a grease (a fatty oil), and a fatty acid ester. Examples of the mineral oil for forming the component (a) include a machine oil, a turbine oil, a spindle oil, a process oil, and the like. An example of the synthetic hydrocarbon for forming the component (a) is polyalphaolefin. Examples of the grease for forming the component (a) are an animal or plant oil, such as a soybean oil, a colza oil, a ricinus, a palm oil, and a beef tallow. An example of the fatty acid ester for forming the component (a) is an ester which is formed by reaction of a fatty acid and a monohydroxy or polyhydroxylic alcohol, the fatty acid being a lauric acid, a myristic acid, a palmitic acid, a palmitoleic acid, a stearic acid, an oleic acid, a vaccenic acid, a linoleic acid, a linolenic acid, an arachidic acid, and the like. Examples of the monohydroxy or polyhydroxylic alcohol are the monohydroxy alcohol whose carbon number is 1 to 18, such as a 2-ethyl hexanol, an isodecanol, and a tridecanol; a trimethylolpropane; a pentaerythritol; a neopentyl glycol; a dipentaerythritol; and the like.

The component (a) is not limited to the examples described above. It is preferable that the kinetic viscosity of the component (a) be in a range from 5 to 500 $mm^2$/sec. at 40° C. in terms of the usage as the lubricant. If the kinetic viscosity is lower than the above range, the lubricating property of the lubricant is unsatisfactory (lubrication capacity is too low). If the kinetic viscosity is higher than the above range, it is difficult to clean up the residues of the lubricant which are spattered during the injection of the molten metal (easiness of being cleaned is poor) so that the usage environment worsens.

It is preferable that the burning (flash) point of the component (a) be equal to or higher than 200° C. in terms of the usage as the lubricant. If the burning (flash) point is lower than 200° C. the lubricant easily burns.

It is suitable that the content (contained amount) of the component (a) be 0.1 to 20 weight % with respect to a total weight of the lubricant. Preferably, the content of the component (a) is 0.5 to 18 weight %, and more preferably, 1 to 16 weight %. If the content of the component (a) is lower than 0.1 weight %, the lubricating property is unsatisfactory. If the content of the component (a) is higher than 20 weight %, it is difficult to satisfactorily suppress the burn of the lubricant when the lubricant contacts with the molten metal. When the content of the component (a) is 0.5 to 18 weight %, the lubricating property of the lubricant is satisfactorily excellent (lubrication capacity is high), and the burn of the lubricant can be easily suppressed. When the content of the component (a) is 1 to 16 weight %, the lubricating property of the lubricant is more excellent, and the burn of the lubricant can be more easily suppressed. The component (a) may be one chemical compound or two or more of chemical compounds, selected from the group consisting of the mineral oil, the synthetic hydrocarbon, the grease, and the fatty acid ester. The two or more of the chemical compounds may be selected from one kind among/of the mineral oil, the synthetic hydrocarbon, the grease, and the fatty acid ester, or may be selected from multiple kinds among/of the mineral oil, the synthetic hydrocarbon, the grease, and the fatty acid ester. When the component (a) consists of the two or more of the compounds, a total content of those compounds should be within the above described range.

<Component (b)>

The component (b) is one or more than one of chemical compounds selected from the group consisting of an alkali metal salt of a higher fatty acid and an alkali metal salt of an aliphatic hydroxy acid. Examples of the higher fatty acid for forming the component (b) include a lauric acid, a myristic acid, a palmitic acid, a palmitoleic acid, a stearic acid, an oleic acid, a vaccenic acid, a linoleic acid, a linolenic acid, and an arachidic acid. A lauric acid, a palmitic acid, a palmitoleic acid, a stearic acid, an oleic acid, a linoleic acid, and a linolenic acid are preferably used, and palmitoleic acid, oleic acid, and linoleic acid are more preferably used. Examples of the aliphatic hydroxy acid for forming the component (b) are an acidum lacticum, a citric acid, a malic acid, a ricinoleic acid, and the like, and a ricinoleic acid is preferably used.

Examples of the alkali metal which forms the component (b) together with the higher fatty acid and/or the aliphatic hydroxy acid are natrium, lithium, kalium, and the like, and natrium and kalium are preferably used.

Although the component (b) is the alkali metal salt of the higher fatty acid or the alkali metal salt of the aliphatic hydroxy acid, kinds of the higher fatty acid, the aliphatic hydroxy acid, and the alkali metal are not limited, as long as the component (b) is water-soluble as the component of the lubricant It is suitable that the content of the component (b) be 0.1 to 30 weight % with respect to the total weight of the lubricant. Preferably, the content of the component (b) is 1 to 27 weight %, and more preferably, 2 to 24 weight %. If the content of the component (b) is lower than 0.1 weight %, the lubricating property of the lubricant and/or the easiness of being cleaned (property of the lubricant adhered to the surround/circumference of the apparatus to be cleaned up) of the lubricant is/are unsatisfactory. If the content of the component (b) is higher than 30 weight %, it is difficult to satisfactorily suppress the burn of the lubricant when the lubricant contacts with the molten metal. When the content of the component (b) is 1 to 27 weight %, the lubricating property and the easiness of being cleaned are both satisfactory, and the burn of the lubricant can be satisfactorily suppressed. When the content of the component (b) is 2 to 24 weight %, the lubricating property and the easiness of being cleaned are more excellent, and the burn of the lubricant can be more satisfactorily suppressed. The component (b) may be one chemical compound or two or more of the chemical compounds, selected from the group consisting of the alkali metal salt of the higher fatty acid and the alkali metal salt of the aliphatic hydroxy acid. The two or more of the chemical compounds may be selected from one kind among/of the alkali metal salt of the higher fatty acid and the alkali metal salt of the aliphatic hydroxy acid, or may be selected from multiple kinds among/of the alkali metal salt of the higher fatty acid and the alkali metal salt of the aliphatic hydroxy acid. When the component (b) consists of two or more of the compounds, a total content of those compounds should be within the above described range.

<Component (c)>

The component (c) is one or more than one of compounds selected from the group consisting of an alkali metal salt of a synthetic sulfonic acid and an alkali metal salt of a petroleum sulfonic acid. The sulfonic acid for forming the component (c) is not specifically limited, however, may be an oil fraction-derived petroleum sulfonic acid, a synthetic sulfonic acid derived by alkylation of an aromatic compound, and a mixture component of the petroleum sulfonic acid and the synthetic sulfonic acid, for example.

Examples of the alkali metal which forms the component (c) together with the petroleum sulfonic acid or the synthetic sulfonic acid are natrium, lithium, kalium, and the like, and natrium and kalium are preferably used.

Although the component (c) is the alkali metal salt of the synthetic sulfonic acid or the alkali metal salt of the petroleum sulfonic acid, kinds of the alkali metal salt of the synthetic sulfonic acid and the alkali metal salt of the petroleum sulfonic acid are not limited, as long as the component (c) is water-soluble as the component of the lubricant.

It is suitable that the content of the component (c) be 0.1 to 20 weight % with respect to the total weight of the lubricant. Preferably, the content of the component (c) is 0.5 to 18 weight %, and more preferably, 1 to 16 weight %. If the content of the component (c) is lower than 0.1 weight %, the easiness of being cleaned is poor. If the content of the component (c) is higher than 20 weight %, it is difficult to satisfactorily suppress the burn of the lubricant when the lubricant contacts with the molten metal. When the content of the component (c) is 0.5 to 18 weight %, the easiness of being cleaned is satisfactory, and the burn of the lubricant can be satisfactorily suppressed. When the content of the component (c) is 1 to 16 weight %, the easiness of being cleaned is improved, and the burn of the lubricant can be more satisfactorily suppressed. The component (c) may be one chemical compound or two or more of chemical compounds, selected from the group consisting of the alkali metal salt of the petroleum sulfonic acid and the alkali metal salt of the synthetic sulfonic acid. When the component (c) consists of two or more of the compounds, a total content of those compounds should be within the above described range.

<Particulate (Fine Particle) Silica>

The particulate silica is classified into a wet-type, a dry-type, or the like, depending on a manufacturing method. The particulate silica can be obtained by any method.

A particulate size of the particulate silica is not specifically limited, as long as the object of the present invention is achieved. When the particulate size of the particulate silica is measured by a coulter counter, a maximum particle size of the secondary agglomerated particle of the particulate silica dispersed in a solvent is preferably equal to or smaller than 20 μm, and is more preferably equal to or smaller than 10 μm. When the maximum particle size of the secondary agglomerated particle is equal to or smaller than 20 μm, the dispersibility of the particulate silica in the lubricant is excellent. When the maximum particle size of the secondary agglomerated particle is equal to or smaller than 10 μm, the dispersibility of the particulate silica in the lubricant is more excellent.

It is suitable that the content of the particulate silica be 0.1 to 5 weight % with respect to the total weight of the lubricant. Preferably, the content of the particulate silica is 0.2 to 3 weight %. When the content of the particulate silica is lower than 0.1 weight %, the seize resistance of the lubricant is lost. When the content of the particulate silica is higher than 5 weight %, not only the performance (seize resistance) cannot be improved, but also it is difficult to use the lubricant, and the residues increase, because the particulate silica is not satisfactorily dispersed, and thus, easily deposits. Accordingly, the easiness of being cleaned (property of the lubricant adhered to the surround/circumference of the apparatus to be cleaned up) of the lubricant is unsatisfactory, resulting in a problem that the surround of the apparatus becomes dirty. When the content of the particulate silica is 0.2 to 3 weight %, the seize resistance is excellent, and the stability of the lubricant as well as the easiness of being cleaned are satisfactory.

The rest component other than the components (a), (b), (c), and the particulate silica, described above, in the lubricant is water. The content of the water is expressed by excluding the solid content concentration from the total amount of the lubricant. The content of the water is, for example, equal to or higher than 50 weight %, preferably 50 to 90 weight %, and more preferably 55 to 85 weight %, with respect to the total weight of the lubricant. Since the content of the water is high, the lubricant according to the present embodiment is in a form of the O/W type emulsion. When the content of the water is lower than 50 weight %, the burn of the lubricant can not be satisfactorily suppressed, since the oil content is high. In addition, since the product form of the lubricant changes in phase from the O/W type emulsion to the W/O type emulsion so that the viscosity increases, workability worsens when supplying the lubricant into the sleeve. On the other hand, when the content of the water is higher than 90 weight %, the satisfactory lubricating property and the satisfactory seize resistance are not obtained since the lubricating component relatively decreases, and thus, it cannot be used as the lubricant. It should be noted that the solid content concentration means a ratio of a total weight of the components (a) to (c), the particulate silica, and additives described later, to the total weight of the lubricant.

The lubricant according to the present embodiment may contain an additive which is conventionally added to a lubricant in a field of the lubricant for die-casting, e.g., a so-called viscosity improver, a preservative agent, a rust preventing agent, a sequestering agent, a surface-activating agent, or the like. The lubricant according to the present embodiment may be supplied to a target portion (sleeve) by any method. For example, the lubricant can be supplied by spraying the lubricant to the inner walls of the sleeve.

In the lubricant according to the present embodiment, each of the contents of each component is adjusted in such a manner that the each of the contents of each component becomes within each of the ranges described above.

Further, when each content of the component (a), the component (b), the component (c), the particulate silica, and the water is within each range described above, functions obtained through mutual interactions among the components are added to functions of the components. As a result, an excellent lubricating property is exerted as the lubricant, and the burn of the lubricant can be satisfactorily suppressed when the lubricant contacts with the molten metal.

The thus configured lubricant according to the present embodiment may be used as an undiluted solution. Further, in consideration of the economic aspect as well as the transportation, a material containing solid content of the lubricant in large amount is produced beforehand in such a manner that the stability of the lubricant is not lost, and the material may be diluted within the range described above before the usage.

EXAMPLE 1

Hereinafter, the present invention is more specifically described using examples, however, it is obvious that the present invention should not be construed as limiting to the embodiments.

In order to demonstrate the performance of the plunger water-soluble lubricant for die-casting of the present invention, experiments described below were carried out with respect to lubricants having the composition as described in tables 1 to 11 (examples) and a table 12 (comparative example), and their performances were evaluated. When carrying out the experiments, the lubricants itself were used without being diluted. Among compositions shown in the tables 1 to 12, the colza oil manufactured by the Nisshin OHIO Group, Ltd., the trimethylolpropane trioleate ester manufactured by NOF corporation, Diana Fresia (Trademark) U-46 manufactured by Idemitsu Kosan Co., Ltd. as the mineral oil, and SpectraSyn (Trademark) 6 manufactured by Exxon Mobil Corporation as the polyalphaolefin were used. The oleic acid manufactured by Kao Corporation, and the ricinoleic acid manufactured by Kokura Synthetic Industries, Ltd were used. Each of the oleic acid and the ricinoleic acid was changed to a neutralization equivalent salt with alkali metal. SULFOL (Trademark) 430A manufactured by MORESCO Corporation as the petroleum sodium sulfonate salt, MORESCO-AMBER SN-60 manufactured by MORESCO as the synthetic sodium sulfonate salt, FINE SEAL (Trademark) X-45 manufactured by Tokuyama Corporation as the particulate silica, and SP-40 manufactured by Fuji Talc Industrial Co., Ltd. as the talc were used.

It should be noted that the viscosity of the colza oil is 37 $mm^2$/sec. (40° C.), and its burning (flash) point is equal to or higher than 300° C. The viscosity of the trimethylolpropane trioleate ester is 48 $mm^2$/sec. (40° C.), and its burning (flash) point is equal to or higher than 314° C. The viscosity of the Diana Fresia (Trademark) U-46 is 46 $mm^2$/sec., and its burning (flash) point is equal to or higher than 100° C. and equal to or lower than 200° C. The viscosity of the SpectraSyn (Trademark) 6 is 31 $mm^2$/sec., and its burning (flash) point is equal to 230° C.

TABLE 1

| Component (weight %) | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|
| colza oil (component (a)) | 3 | 3 | 3 | 3 | 3 | 3 | 3 | 3 | 3 | 3 | 3 | 3 |
| potassium oleate (component (b)) | 8 | 8 | 8 | 14 | 14 | 14 | — | — | — | — | — | — |
| sodium ricinoleate (component (b)) | — | — | — | — | — | — | 14 | 14 | 14 | 20 | 20 | 20 |
| sodium petroleum sulphonate (component (c)) | 3 | 8 | 13 | 3 | 8 | 13 | 3 | 8 | 13 | 3 | 8 | 13 |
| particulate silica | 1.5 | 1.5 | 1.5 | 1.5 | 1.5 | 1.5 | 1.5 | 1.5 | 1.5 | 1.5 | 1.5 | 1.5 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 84 | 79 | 74 | 78 | 73 | 68 | 78 | 73 | 68 | 72 | 67 | 62 |

TABLE 2

| Component (weight %) | Example 13 | Example 14 | Example 15 | Example 16 | Example 17 | Example 18 | Example 19 | Example 20 | Example 21 | Example 22 | Example 23 | Example 24 |
|---|---|---|---|---|---|---|---|---|---|---|---|---|
| colza oil (component (a)) | 8 | 8 | 8 | 8 | 8 | 8 | 8 | 8 | 8 | 8 | 8 | 8 |
| potassium oleate (component (b)) | 8 | 8 | 8 | 14 | 14 | 14 | — | — | — | — | — | — |
| sodium ricinoleate (component (b)) | — | — | — | — | — | — | 14 | 14 | 14 | 20 | 20 | 20 |
| sodium petroleum sulphonate (component (c)) | 3 | 8 | 13 | 3 | 8 | 13 | 3 | 8 | 13 | 3 | 8 | 13 |
| particulate silica | 1.5 | 1.5 | 1.5 | 1.5 | 1.5 | 1.5 | 1.5 | 1.5 | 1.5 | 1.5 | 1.5 | 1.5 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 79 | 74 | 69 | 73 | 68 | 63 | 73 | 68 | 63 | 67 | 62 | 57 |

TABLE 3

| Component (weight %) | Example 25 | Example 26 | Example 27 | Example 28 | Example 29 | Example 30 | Example 31 | Example 32 | Example 33 | Example 34 | Example 35 | Example 36 |
|---|---|---|---|---|---|---|---|---|---|---|---|---|
| trimethylolpropane trioleate (component (a)) | 3 | 3 | 3 | 3 | 3 | 3 | 3 | 3 | 3 | 3 | 3 | 3 |
| potassium oleate (component (b)) | 8 | 8 | 8 | 14 | 14 | 14 | — | — | — | — | — | — |
| sodium ricinoleate (component (b)) | — | — | — | — | — | — | 14 | 14 | 14 | 20 | 20 | 20 |
| sodium petroleum sulphonate (component (c)) | 3 | 8 | 13 | 3 | 8 | 13 | 3 | 8 | 13 | 3 | 8 | 13 |
| particulate silica | 1.5 | 1.5 | 1.5 | 1.5 | 1.5 | 1.5 | 1.5 | 1.5 | 1.5 | 1.5 | 1.5 | 1.5 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 81 | 79 | 74 | 78 | 73 | 68 | 78 | 73 | 68 | 72 | 67 | 62 |

TABLE 4

| Component (weight %) | Example 37 | Example 38 | Example 39 | Example 40 | Example 41 | Example 42 | Example 43 | Example 44 | Example 45 | Example 46 | Example 47 | Example 48 |
|---|---|---|---|---|---|---|---|---|---|---|---|---|
| trimethylolpropane trioleate (component (a)) | 13 | 13 | 13 | 13 | 13 | 13 | 13 | 13 | 13 | 13 | 13 | 13 |

TABLE 4-continued

| Component (weight %) | Example 37 | Example 38 | Example 39 | Example 40 | Example 41 | Example 42 | Example 43 | Example 44 | Example 45 | Example 46 | Example 47 | Example 48 |
|---|---|---|---|---|---|---|---|---|---|---|---|---|
| potassium oleate (component (b)) | 8 | 8 | 8 | 14 | 14 | 14 | — | — | — | — | — | — |
| sodium ricinoleate (component (b)) | — | — | — | — | — | — | 14 | 14 | 14 | 20 | 20 | 20 |
| sodium petroleum sulphonate (component (c)) | 3 | 8 | 13 | 3 | 8 | 13 | 3 | 8 | 13 | 3 | 8 | 13 |
| particulate silica | 1.5 | 1.5 | 1.5 | 1.5 | 1.5 | 1.5 | 1.5 | 1.5 | 1.5 | 1.5 | 1.5 | 1.5 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 74 | 69 | 64 | 68 | 63 | 58 | 68 | 63 | 58 | 62 | 57 | 52 |

TABLE 5

| Component (weight %) | Example 49 | Example 50 | Example 51 | Example 52 | Example 53 | Example 54 | Example 55 | Example 56 | Example 57 | Example 58 | Example 59 | Example 60 |
|---|---|---|---|---|---|---|---|---|---|---|---|---|
| mineral oil (component (a)) | — | 8 | 8 | 8 | — | 8 | 8 | 8 | — | 8 | — | 8 |
| polyalphaolefin (component (a)) | 8 | | | | 8 | | | | 8 | | 8 | |
| potassium oleate (component (b)) | 8 | 8 | 8 | 14 | 14 | 14 | — | — | — | — | — | — |
| sodium ricinoleate (component (b)) | — | — | — | — | — | — | 14 | 14 | 14 | 20 | 20 | 20 |
| sodium petroleum sulphonate (component (c)) | 3 | 8 | 13 | 3 | 8 | 13 | 3 | 8 | 13 | 3 | 8 | 13 |
| particulate silica | 1.5 | 1.5 | 1.5 | 1.5 | 1.5 | 1.5 | 1.5 | 1.5 | 1.5 | 1.5 | 1.5 | 1.5 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 79 | 74 | 69 | 73 | 68 | 63 | 73 | 68 | 63 | 67 | 62 | 57 |

TABLE 6

| Component (weight %) | Example 61 | Example 62 | Example 63 | Example 64 | Example 65 | Example 66 | Example 67 | Example 68 | Example 69 | Example 70 | Example 71 | Example 72 |
|---|---|---|---|---|---|---|---|---|---|---|---|---|
| mineral oil (component (a)) | 13 | 13 | — | — | 13 | 13 | 13 | 13 | — | — | 13 | 13 |
| polyalphaolefin (component (a)) | | | 13 | 13 | | | | | 13 | 13 | | |
| potassium oleate (component (b)) | 8 | 8 | 8 | 14 | 14 | 14 | — | — | — | — | — | — |
| sodium ricinoleate (component (b)) | — | — | — | — | — | — | 14 | 14 | 14 | 20 | 20 | 20 |
| sodium petroleum sulphonate (component (c)) | 3 | 8 | 13 | 3 | 8 | 13 | 3 | 8 | 13 | 3 | 8 | 13 |
| particulate silica | 1.5 | 1.5 | 1.5 | 1.5 | 1.5 | 1.5 | 1.5 | 1.5 | 1.5 | 1.5 | 1.5 | 1.5 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 74 | 69 | 64 | 68 | 63 | 58 | 68 | 63 | 58 | 62 | 57 | 52 |

TABLE 7

| Component (weight %) | Example 73 | Example 74 | Example 75 | Example 76 | Example 77 | Example 78 | Example 79 | Example 80 | Example 81 | Example 82 | Example 83 | Example 84 |
|---|---|---|---|---|---|---|---|---|---|---|---|---|
| colza oil (component (a)) | 3 | 3 | 3 | 3 | 3 | 3 | 3 | 3 | 8 | 8 | 8 | 8 |
| potassium oleate (component (b)) | 8 | 8 | 14 | 14 | — | — | — | — | 8 | 8 | 14 | 14 |
| sodium ricinoleate (component (b)) | — | — | — | — | 14 | 14 | 20 | 20 | — | — | — | — |
| sodium petroleum sulphonate (component (c)) | 3 | 3 | 8 | 8 | 13 | 13 | 3 | 3 | 8 | 8 | 13 | 13 |
| particulate silica | 0.5 | 3 | 0.5 | 3 | 0.5 | 3 | 0.5 | 3 | 0.5 | 3 | 0.5 | 3 |

TABLE 7-continued

| Component (weight %) | Example 73 | Example 74 | Example 75 | Example 76 | Example 77 | Example 78 | Example 79 | Example 80 | Example 81 | Example 82 | Example 83 | Example 84 |
|---|---|---|---|---|---|---|---|---|---|---|---|---|
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 85 | 82.5 | 74 | 71.5 | 69 | 66.5 | 73 | 70.5 | 75 | 72.5 | 64 | 61.5 |

TABLE 8

| Component (weight %) | Example 85 | Example 86 | Example 87 | Example 88 | Example 89 | Example 90 | Example 91 | Example 92 | Example 93 | Example 94 | Example 95 | Example 96 |
|---|---|---|---|---|---|---|---|---|---|---|---|---|
| colza oil (component (a)) | 8 | 8 | 8 | 8 | — | — | — | — | — | — | — | — |
| trimethylolpropane trioleate (component (a)) | — | — | — | — | 3 | 3 | 3 | 3 | 3 | 3 | 3 | 3 |
| potassium oleate (component (b)) | — | — | — | — | 8 | 8 | 14 | 14 | — | — | — | — |
| sodium ricinoleate (component (b)) | 14 | 14 | 20 | 20 | — | — | — | — | 14 | 14 | 20 | 20 |
| sodium petroleum sulphonate (component (c)) | 3 | 3 | 8 | 8 | 13 | 13 | 3 | 3 | 8 | 8 | 13 | 13 |
| particulate silica | 0.5 | 3 | 0.5 | 3 | 0.5 | 3 | 0.5 | 3 | 0.5 | 3 | 0.5 | 3 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 74 | 71.5 | 63 | 60.5 | 75 | 72.5 | 79 | 76.5 | 74 | 71.5 | 63 | 60.5 |

TABLE 9

| Component (weight %) | Example 97 | Example 98 | Example 99 | Example 100 | Example 101 | Example 102 | Example 103 | Example 104 | Example 105 | Example 106 | Example 107 | Example 108 |
|---|---|---|---|---|---|---|---|---|---|---|---|---|
| trimethylolpropane trioleate (component (a)) | 13 | 13 | 13 | 13 | 13 | 13 | 13 | 13 | — | — | — | — |
| mineral oil (component (a)) | — | — | — | — | — | — | — | — | 8 | 8 | 8 | 8 |
| potassium oleate (component (b)) | 8 | 8 | 14 | 14 | — | — | — | — | 8 | 8 | 14 | 14 |
| sodium ricinoleate (component (b)) | — | — | — | — | 14 | 14 | 20 | 20 | — | — | — | — |
| sodium petroleum sulphonate (component (c)) | 3 | 3 | 8 | 8 | 13 | 13 | 3 | 3 | 8 | 8 | 13 | 13 |
| particulate silica | 0.5 | 3 | 0.5 | 3 | 0.5 | 3 | 0.5 | 3 | 0.5 | 3 | 0.5 | 3 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 75 | 72.5 | 64 | 61.5 | 59 | 56.5 | 63 | 60.5 | 75 | 72.5 | 64 | 61.5 |

TABLE 10

| Component (weight %) | Example 109 | Example-110 | Example 111 | Example 112 | Example 113 | Example 114 | Example 115 | Example 116 | Example 117 | Example 118 | Example 119 | Example 120 |
|---|---|---|---|---|---|---|---|---|---|---|---|---|
| mineral oil (component (a)) | 8 | 8 | 8 | 8 | 13 | 13 | 13 | 13 | 13 | 13 | 13 | 13 |
| potassium oleate (component (b)) | — | — | — | — | 8 | 8 | 14 | 14 | — | — | — | — |
| sodium ricinoleate (component (b)) | 14 | 14 | 20 | 20 | — | — | — | — | 14 | 14 | 20 | 20 |
| sodium petroleum sulphonate (component (c)) | 3 | 3 | 8 | 8 | 13 | 13 | 3 | 3 | 8 | 8 | 13 | 13 |
| particulate silica | 0.5 | 3 | 0.5 | 3 | 0.5 | 3 | 0.5 | 3 | 0.5 | 3 | 0.5 | 3 |
| surface-activating agent | 0.5 | 0.5 | 0.5 | 0.5 | 0.5 | 0.5 | 0.5 | 0.5 | 0.5 | 0.5 | 0.5 | 0.5 |
| deionized water | 74 | 71.5 | 63 | 60.5 | 65 | 62.5 | 69 | 66.5 | 64 | 61.5 | 53 | 50.5 |

TABLE 11

| Component (weight %) | Example 121 | Example 122 | Example 123 | Example 124 | Example 125 | Example 126 | Example 127 |
|---|---|---|---|---|---|---|---|
| mineral oil (component (a)) | 4 | 8 | 8 | 4 | 4 | 8 | 4 |
| colza oil (component (a)) | 4 | | | 4 | 4 | | 4 |
| potassium oleate (component (b)) | — | 4 | — | 4 | — | 4 | 4 |
| sodium ricinoleate (component (b)) | 8 | 4 | 8 | 4 | 8 | 4 | 4 |
| sodium petroleum sulphonate (component (c)) | 8 | 4 | 4 | 8 | 4 | 4 | 4 |
| synthetic sodium sulfonate (component (c)) | | | 4 | | 4 | 4 | 4 |
| particulate silica | 1.5 | 1.5 | 1.5 | 1.5 | 1.5 | 1.5 | 1.5 |
| surface-activating agent | 0.5 | 0.5 | 0.5 | 0.5 | 0.5 | 0.5 | 0.5 |
| deionized water | 74 | 74 | 74 | 74 | 74 | 74 | 74 |

TABLE 12

| Component (weight %) | Comparative example 1 | Comparative example 2 | Comparative example 3 | Comparative example 4 | Comparative example 5 | Comparative example 6 | Comparative example 7 |
|---|---|---|---|---|---|---|---|
| colza oil (component (a)) | — | 8 | 8 | 8 | 8 | 16 | — |
| mineral oil (component (a)) | — | — | — | — | — | — | 85 |
| sodium ricinoleate (component (b)) | 14 | — | 14 | 14 | 14 | 28 | — |
| sodium petroleum sulphonate (component (c)) | 8 | 8 | — | 8 | 8 | 16 | — |
| particulate silica | 1.5 | 1.5 | 1.5 | — | 10 | 1.5 | — |
| talc | — | — | — | — | — | — | 15 |
| surface-activating agent | 0.5 | 0.5 | 0.5 | 0.5 | 0.5 | 0.5 | — |
| deionized water | 76 | 82 | 76 | 68.5 | 59.5 | 38 | — |

(Lubricating Property Test)

Lubricating property tests were carried out with respect to each of the lubricants shown in Tables 1 to 12 using Tribotester (manufactured by Kyoshin Co., Ltd.) to measure friction coefficients. The test conditions are as follows.

Load; 500 g

Steel ball; SUJ-2

Steel plate; JIS (Japanese Industrial Standards) G3141 SPCC-SB

Measurement time; 5 minutes

Surface temperature; 300° C.

Sliding speed; 30 times/minute

Sliding distance; 5 mm

Sample; 0.03 g

The seize resistance and the lubricating property were evaluated based on the test results (friction coefficients) obtained through the lubricating property test. The seize resistance was evaluated based on a standard described below.

○: An abrupt increase of the friction coefficient does not occur within 5 minutes.

×: An abrupt increase of the friction coefficient occurs within 5 minutes.

The lubricating property was evaluated based on a standard described below.

○: The measured friction coefficient continues to be 0.05 or lower for 5 minutes (being practically excellent)

Δ: The measured friction coefficient continues to be 0.10 or lower for 5 minutes (having no practical problem)

×: The measured friction coefficient becomes equal to or higher than 0.10 within 5 minutes (having a practical problem)

(Burnability (Flammability) Test)

Each of the lubricants having the composition shown in the tables 1 to 12 is delivered by drops of 3 ml onto a steel plate which has been heated to 260° C. in advance, and is spread. A steel plate which has been heated to 800° C. is placed on the surface of the lubricant, and the generation of smoke and the burning of the lubricant under such a condition were observed. The burnability of the lubricant was evaluated based on the observation results, according to a standard described below.

○: A little smoke is observed, and the lubricant does not burn.

Δ: A large amount of smoke is observed, but the lubricant does not burn.

×: A large amount of smoke is observed, and the lubricant burns.

(Test of the Easiness of Being Cleaned)

Each of the lubricants having the composition shown in the tables 1 to 12 is delivered by drops of 3 ml onto a steel plate which has been heated to 260° C. in advance, and the portion where the lubricant is dropped is dried. Thereafter, the easiness of being cleaned (degree of elimination of the lubricant) is observed when the dried portion is flushed/washed with water. The easiness of being cleaned was evaluated based on the observation results, according to a standard described below.

○: The lubricant on the steel plate is washed out (degree of contaminating is low).

×: The lubricant on the steel plate is not washed out (degree of contaminating is high).

The evaluation results of the lubricants according to the present examples having the composition shown in the tables 1 to 11 are shown in tables 13 to 23, respectively. The evaluation results of the lubricant of the comparative example having the composition shown in the table 12 is shown in a table 24.

TABLE 13

| Component (weight %) | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | ○ | Δ | Δ | ○ | ○ | Δ | ○ | ○ | Δ | ○ | ○ | ○ |
| burnability | ○ | ○ | Δ | ○ | Δ | Δ | ○ | Δ | Δ | ○ | Δ | Δ |
| easiness of being cleaned | ○ | ○ | ○ | ○ | ○ | ○ | ○ | ○ | ○ | ○ | ○ | ○ |

TABLE 14

| Component (weight %) | Example 13 | Example 14 | Example 15 | Example 16 | Example 17 | Example 18 | Example 19 | Example 20 | Example 21 | Example 22 | Example 23 | Example 24 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | ○ | ○ | ○ | ○ | ○ | ○ | ○ | ○ | ○ | ○ | ○ | ○ |
| burnability | ○ | Δ | Δ | ○ | Δ | Δ | ○ | Δ | Δ | ○ | Δ | Δ |
| easiness of being cleaned | ○ | ○ | ○ | ○ | ○ | ○ | ○ | ○ | ○ | ○ | ○ | ○ |

TABLE 15

| Component (weight %) | Example 25 | Example 26 | Example 27 | Example 28 | Example 29 | Example 30 | Example 31 | Example 32 | Example 33 | Example 34 | Example 35 | Example 36 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | ○ | Δ | Δ | ○ | ○ | Δ | ○ | ○ | Δ | ○ | ○ | ○ |
| burnability | ○ | ○ | Δ | ○ | Δ | Δ | ○ | Δ | Δ | ○ | Δ | Δ |
| easiness of being cleaned | ○ | ○ | ○ | ○ | ○ | ○ | ○ | ○ | ○ | ○ | ○ | ○ |

TABLE 16

| Component (weight %) | Example 37 | Example 38 | Example 39 | Example 40 | Example 41 | Example 42 | Example 43 | Example 44 | Example 45 | Example 46 | Example 47 | Example 48 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | ○ | ○ | ○ | ○ | ○ | ○ | ○ | ○ | ○ | ○ | ○ | ○ |
| burnability | ○ | Δ | Δ | ○ | Δ | Δ | ○ | Δ | Δ | Δ | Δ | Δ |
| easiness of being cleaned | ○ | ○ | ○ | ○ | ○ | ○ | ○ | ○ | ○ | ○ | ○ | ○ |

TABLE 17

| Component (weight %) | Example 49 | Example 50 | Example 51 | Example 52 | Example 53 | Example 54 | Example 55 | Example 56 | Example 57 | Example 58 | Example 59 | Example 60 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | Δ | Δ | Δ | Δ | Δ | Δ | Δ | Δ | Δ | Δ | Δ | Δ |
| burnability | Δ | Δ | Δ | Δ | Δ | Δ | Δ | Δ | Δ | Δ | Δ | Δ |
| easiness of being cleaned | ○ | ○ | ○ | ○ | ○ | ○ | ○ | ○ | ○ | ○ | ○ | ○ |

TABLE 18

| Component (weight %) | Example 61 | Example 62 | Example 63 | Example 64 | Example 65 | Example 66 | Example 67 | Example 68 | Example 69 | Example 70 | Example 71 | Example 72 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | Δ | Δ | Δ | Δ | Δ | Δ | Δ | Δ | Δ | Δ | Δ | Δ |

TABLE 18-continued

| Component (weight %) | Example 61 | Example 62 | Example 63 | Example 64 | Example 65 | Example 66 | Example 67 | Example 68 | Example 69 | Example 70 | Example 71 | Example 72 |
|---|---|---|---|---|---|---|---|---|---|---|---|---|
| burnability | Δ | Δ | Δ | Δ | Δ | Δ | Δ | Δ | Δ | Δ | Δ | Δ |
| easiness of being cleaned | ○ | ○ | ○ | ○ | ○ | ○ | ○ | ○ | ○ | ○ | ○ | ○ |

TABLE 19

| Component (weight %) | Example 73 | Example 74 | Example 75 | Example 76 | Example 77 | Example 78 | Example 79 | Example 80 | Example 81 | Example 82 | Example 83 | Example 84 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | ○ | ○ | ○ | ○ | Δ | Δ | ○ | ○ | ○ | ○ | ○ | ○ |
| burnability | ○ | ○ | Δ | Δ | Δ | Δ | ○ | ○ | Δ | Δ | Δ | Δ |
| easiness of being cleaned | ○ | ○ | ○ | ○ | ○ | ○ | ○ | ○ | ○ | ○ | ○ | ○ |

TABLE 20

| Component (weight %) | Example 85 | Example 86 | Example 87 | Example 88 | Example 89 | Example 90 | Example 91 | Example 92 | Example 93 | Example 94 | Example 95 | Example 96 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | ○ | ○ | ○ | ○ | Δ | Δ | ○ | ○ | ○ | ○ | ○ | ○ |
| burnability | ○ | ○ | Δ | Δ | Δ | Δ | ○ | ○ | Δ | Δ | Δ | Δ |
| easiness of being cleaned | ○ | ○ | ○ | ○ | ○ | ○ | ○ | ○ | ○ | ○ | ○ | ○ |

TABLE 21

| Component (weight %) | Example 97 | Example 98 | Example 99 | Example 100 | Example 101 | Example 102 | Example 103 | Example 104 | Example 105 | Example 106 | Example 107 | Example 108 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | ○ | ○ | ○ | ○ | ○ | ○ | ○ | ○ | Δ | Δ | Δ | Δ |
| burnability | ○ | ○ | Δ | Δ | Δ | Δ | Δ | Δ | Δ | Δ | Δ | Δ |
| easiness of being cleaned | ○ | ○ | ○ | ○ | ○ | ○ | ○ | ○ | ○ | ○ | ○ | ○ |

TABLE 22

| Component (weight %) | Example 109 | Example 110 | Example 111 | Example 112 | Example 113 | Example 114 | Example 115 | Example 116 | Example 117 | Example 118 | Example 119 | Example 120 |
|---|---|---|---|---|---|---|---|---|---|---|---|---|
| seize resistance | ○ | ○ | ○ | ○ | ○ | ○ | ○ | ○ | ○ | ○ | ○ | ○ |
| lubricating property | Δ | Δ | Δ | Δ | Δ | Δ | Δ | Δ | Δ | Δ | Δ | Δ |
| burnability | Δ | Δ | Δ | Δ | Δ | Δ | Δ | Δ | Δ | Δ | Δ | Δ |
| easiness of being cleaned | ○ | ○ | ○ | ○ | ○ | ○ | ○ | ○ | ○ | ○ | ○ | ○ |

TABLE 23

| Component (weight %) | Example 121 | Example 122 | Example 123 | Example 124 | Example 125 | Example 126 | Example 127 |
|---|---|---|---|---|---|---|---|
| seize resistance | ○ | ○ | ○ | ○ | ○ | ○ | ○ |
| lubricating property | ○ | Δ | Δ | ○ | ○ | Δ | ○ |
| burnability | Δ | Δ | Δ | Δ | Δ | Δ | Δ |
| easiness of being cleaned | ○ | ○ | ○ | ○ | ○ | ○ | ○ |

TABLE 24

| Component (weight %) | Comparative example 1 | Comparative example 2 | Comparative example 3 | Comparative example 4 | Comparative example 5 | Comparative example 6 | Comparative example 7 |
|---|---|---|---|---|---|---|---|
| seize resistance | X | X | X | X | ○ | ○ | ○ |
| lubricating property | X | X | X | X | Δ | ○ | Δ |
| burnability | Δ | Δ | Δ | Δ | ○ | X | X |
| easiness of being cleaned | ○ | X | X | ○ | X | ○ | X |

According to the performance test results described above, it is understood that the lubricant of the present examples shows an excellent performance in the seize resistance, the lubricating property, and the easiness of being cleaned, and has no practical problem in use. In contrast, the lubricant of the comparative example shows unsatisfactory (poor) performance in at least any one of the seize resistance, the lubricating property, and the easiness of being cleaned, and did not satisfy all of the evaluation items.

(Tests Using an Actual Machine)

Tests using an actual machine was carried out by applying the plunger water-soluble lubricant for die-casting according to the present invention and the conventional oil-based lubricant to the actual machine (die-cast apparatus), to compare between their performances. Changes in the injection speed, the quality of the products, and the status of occurrence of the burn were evaluated, when die-casting aluminum metal according to the following conditions, using the lubricant having the composition shown in the above example 20 as the water-soluble lubricant of the present invention.

Injection (set) speed; 3.0 m/sec.

Material; ADC12

Temperature of the molten metal; 650° C.

Supplying method; Spraying into the sleeve

In addition, aluminum metal was die-casted according to the above conditions, using, as the conventional oil-based lubricant, an oil-based graphite-containing lubricant (product name "Plunger hite TG-YA2" manufactured by Nippon Graphite Industries, Ltd.).

According to the tests using the actual machine, there was little change (decrease) in the injection speed by the plunger, and thus, the lubricating property was satisfactory, when the lubricant having the composition shown in the present example 20 was used, similarly to when the conventional oil-based graphite-containing lubricant was used. In addition, an amount of gas mixed into the molten metal was little, and the internal defect of the die-casted product hardly arose. Further, burning of the lubricant in the sleeve was suppressed. Furthermore, in contrast to (unlike) the case in which the oil-based graphite-containing lubricant was used, there was no graphite powder and no grease/oil-dirt around the actual apparatus, and thus, the working environment was improved.

INDUSTRIAL APPLICABILITY

The lubricant according to the present invention is useful as a lubricant used for die-casting for metal material, such as aluminum, and the like. Especially, the lubricant of the present invention is useful, because it exerts an excellent lubricating property, and can suppress the burning, when it is used as the lubricant for the plunger which directly contact with the molten metal.

The invention claimed is:

1. A water-soluble lubricant, comprising:

0.1 to 20 weight % with respect to a total weight of said lubricant of a component (a) being one or more than one of compounds selected from the group consisting of a mineral oil, a synthetic hydrocarbon, a grease, and a fatty acid ester;

2 to 24 weight % with respect to said total weight of said lubricant of a component (b) being one or more than one of compounds selected from the group consisting of an alkali metal salt of a higher fatty acid and an alkali metal salt of an aliphatic hydroxy acid;

0.1 to 20 weight % with respect to said total weight of said lubricant of a component (c) being one or more than one of compounds selected from the group consisting of an alkali metal salt of a synthetic sulfonic acid and an alkali metal salt of a petroleum sulfonic acid;

0.1 to 5 weight % with respect to said total weight of said lubricant of particulate silica; and at least 50 weight % with respect to said total weight of said lubricant of water.

2. The water-soluble lubricant according to claim 1, wherein, the content of said component (a) is 1 to 16 weight % with respect to a total weight of said lubricant;

the content of said component (b) is 2 to 24 weight % with respect to said total weight of said lubricant;

the content of said component (c) is 1 to 16 weight % with respect to said total weight of said lubricant;

the content of said particulate silica is 0.2 to 3 weight % with respect to said total weight of said lubricant; and the content of said water is 55 to 85 weight % with respect to said total weight of said lubricant.

3. The water-soluble lubricant according to claim 1, wherein, a viscosity of said component (a) is 5 to 500 $mm^2$/sec. at 40° C.

4. The water-soluble lubricant according to claim 1, wherein, said particulate silica has a maximum particle size of its secondary agglomerated particle equal to or smaller than 10 μm when measured by a coulter counter.

5. The water-soluble lubricant according to claim 1, wherein, a flash point of said component (a) is equal to or higher than 200° C.

6. The water-soluble lubricant according to claim 2, wherein, said particulate silica has a maximum particle size of its secondary agglomerated particle equal to or smaller than 10 μm when measured by a coulter counter.

7. The water-soluble lubricant according to claim 2, wherein, a flash point of said component (a) is equal to or higher than 200° C.

8. The water-soluble lubricant according to claim 3, wherein, said particulate silica has a maximum particle size of its secondary agglomerated particle equal to or smaller than 10 μm when measured by a coulter counter.

9. The water-soluble lubricant according to claim 3, wherein, a flash point of said component (a) is equal to or higher than 200° C.

10. The water-soluble lubricant according to claim 4, wherein, a flash point of said component (a) is equal to or higher than 200° C.

11. The water-soluble lubricant according to claim 1, comprising an alkali metal salt of an aliphatic hydroxy acid as component (b).

12. The water-soluble lubricant according to claim 11, comprising an alkali metal salt of ricinoleic acid as component (b).

13. An article of manufacture comprising a plunger for injecting molten metal into a die-cast mold, a sleeve in which the plunger reciprocates, and the lubricant according to claim 1, wherein said lubricant is located between said plunger and said sleeve.

14. A method, comprising supplying the lubricant according to claim 1 between a plunger for injecting molten metal into a die-cast mold and a sleeve in which the plunger reciprocates.

* * * * *